US006210226B1

(12) United States Patent
Zhu et al.

(10) Patent No.: US 6,210,226 B1
(45) Date of Patent: Apr. 3, 2001

(54) ELECTRICAL CONNECTOR HAVING ENHANCED SIDEWARD IMPACT RESISTING STRUCTURE

(75) Inventors: ZiQiang Zhu, KunSan; Zhiquan Mou, Kunsan, both of (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/467,085

(22) Filed: Dec. 10, 1999

(51) Int. Cl.[7] ..... H01R 13/648
(52) U.S. Cl. ..... 439/607
(58) Field of Search ..... 439/607–610

(56) References Cited

U.S. PATENT DOCUMENTS 5,288,248 * 2/1994 Chen ..... 439/609
5,637,015 * 6/1997 Tan et al. ..... 439/609
5,700,164 * 12/1997 Weidler et al. ..... 439/607
5,718,605 * 2/1998 Morikawa et al. ..... 439/607
5,980,320 * 11/1999 Slack et al. ..... 439/607
5,984,726 * 11/1999 Wu ..... 439/607
6,007,381 * 12/1999 Ando et al. ..... 439/607
6,050,853 * 4/2000 Ando et al. ..... 439/607
6,053,773 * 4/2000 Wu ..... 439/609

* cited by examiner

*Primary Examiner*—Gary F. Paumen
(74) *Attorney, Agent, or Firm*—Wei Te Chung

(57) ABSTRACT

An electrical connector according to the present invention comprises a dielectric housing, a plurality of terminals, a front shell and a rear shell. The dielectric housing has an upper portion, a pair of lateral faces, a central portion, and a projecting portion extending forward from a front end of the central portion. Each terminal comprises a contacting portion for being received in the projecting portion of the dielectric housing and a soldering tail for being connected to a printed circuit board. The front shell has a front wall with a front section projecting forwardly therefrom for receiving a mating plug therein. A pair of lateral walls and a pair of retention arms rearwardly extend from, respectively, side edges of the front wall and from a top edge of the front wall. The lateral walls and retention walls have latches, apertures and cutouts for engaging with the dielectric housing and the rear shell. The rear shell comprises a top wall, two side wall and a rear wall, a latching hole being defined in each side wall for interconnection with the front shell, three latching legs depending from the sides of the rear shell for securely mounting the electrical connector to a printed circuit board.

1 Claim, 5 Drawing Sheets

ELECTRICAL CONNECTOR HAVING ENHANCED SIDEWARD IMPACT RESISTING STRUCTURE

BACKGROUND OF THE INVENTION

The present invention relates to an electrical connector having EMI shielding, more particularly to an electrical connector which can reliably resist impacts.

As electrical connectors are more extensively used, a variety of problems such as electromagnetic interference have assumed increased importance. It is now desired that an electrical connector have a reliable EMI shield. Such an electrical connector is disclosed in U.S. Pat. No. 5,718,605. A conventional electrical connector comprises a housing enclosed by a shield case, an upper lid of the shield and a shield base plate. The shield case includes a pair of side plate portions fitting along opposite sides of the housing and a located engaging portion fitting at a front of the housing. A screw fastening piece depends from a bottom edge of each side plate portion of the shield case, from a bottom edge of each side of the upper lid, and from each side of the shield base plate, respectively. Therefore, the electrical connector can be fixed to a printed circuit board by a pair of screws.

The design of the electrical connector requires an inconvenient assembly. Furthermore, the shield case of some prior art electrical connectors is not fixed to the housing at its sides so can not resist side impacts. Additionally, in some prior art connectors a rear side is not fastened to the circuit board and a rear part of the electrical connector will likely disconnect from a printed circuit board (not shown) when the connector is impacted downward at a front portion thereof.

BRIEF SUMMARY OF THE INVENTION

A main object of the present invention is to provide an electrical connector having shielding elements which can firmly secure the dielectric housing of the electrical connector to a printed circuit board and resist impacts to the electrical connector.

Another object of the present invention is to provide an electrical connector which has a desired terminal pitch and can reliably fix terminals in a dielectric housing thereof.

An electrical connector in accordance with the present invention comprises a dielectric housing, a plurality of terminals, a front shell and a rear shell. The dielectric housing includes a central portion, a projecting portion extending forward from a front end of the central portion, an upper portion with a first notch in a front thereof, and a pair of lateral faces each disposed with a pair of retaining plates. A clamping plate is disposed on each of opposite sides of the upper portion, a claw extends and substantially perpendicularly bends from a forward end of the clamping plate. The front shell has a front wall, a pair of lateral walls each extending from each side edge of the front wall for inserting between a corresponding pair of retaining plates of the dielectric housing, and a pair of retention arms depending from 20 an upper edge of the front wall of the front shell for latching to the claws of the dielectric housing. A latching leg respectively depends from a lower edge of each side wall and the rear wall of the rear shell for reliably latching the rear shell onto a printed circuit board. Other objects, advantages and novel features of the invention will become more apparent from the following detailed description when taken in conjunction with the accompanying drawings.

DETAILED DESCRIPTION OF THE INVENTION

Figure 1:
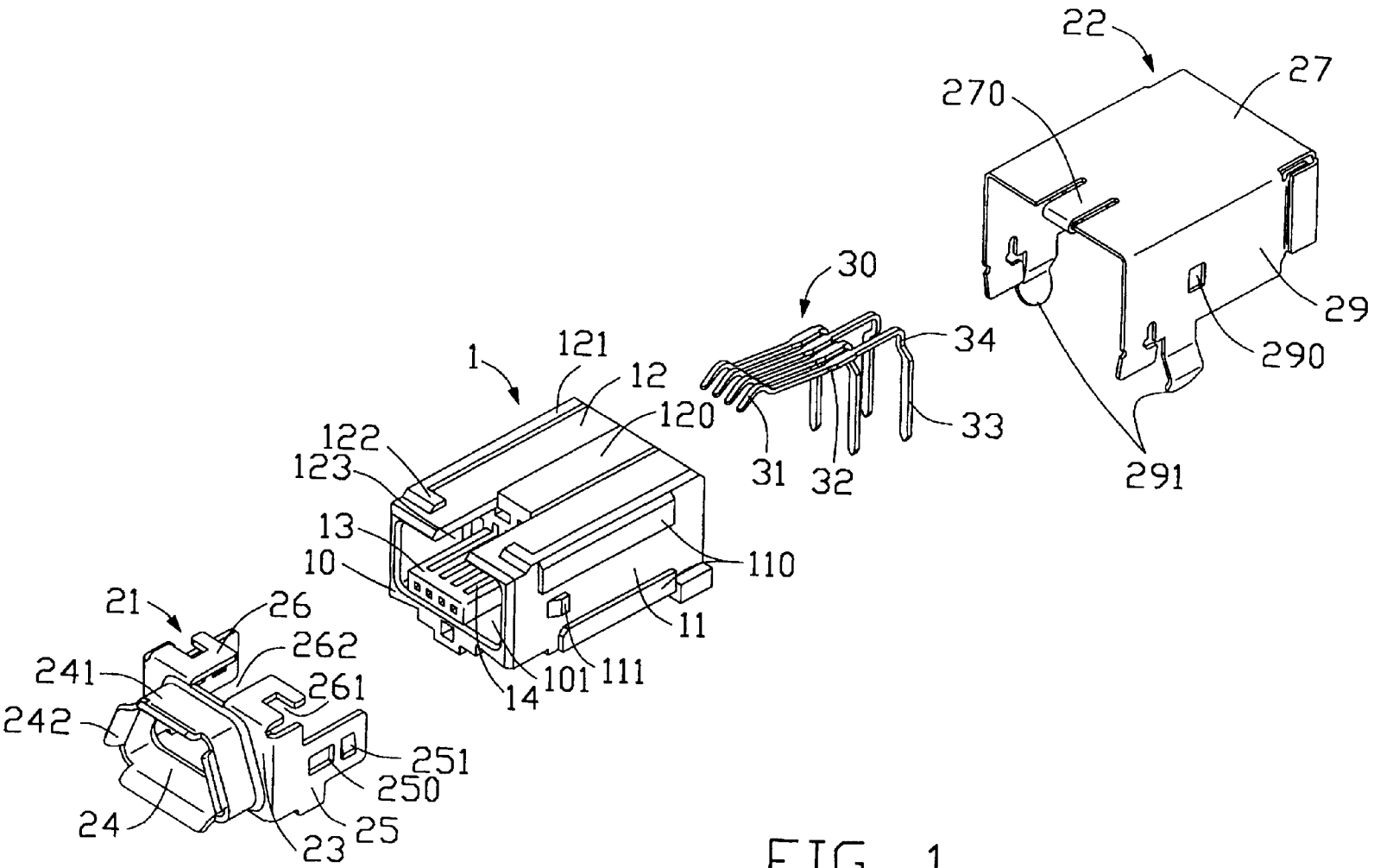
FIG. 1 is an exploded view of an electrical connector of the present invention.

Referring to FIG. 1, an electrical connector according to the present invention comprises a dielectric housing 1, a plurality of terminals 30, a front shell 21 and a rear shell 22.

The dielectric housing 1 includes an upper portion 12 and a pair of lateral faces 11, forming a hollow portion 101 therebetween. A central portion 120 is accommodated in a rearward position of the hollow portion 101, a top of the central portion 120 separating the upper portion 12 in two parts. The upper portion 12 defines a first notch 123 at a front of the central portion 120. A projecting portion 13 extends forward from a front end of the central portion 120 and defines a plurality of channels 14 in a top surface thereof for receiving the terminals 30. A clamping plate 121 is disposed on each of opposite sides of the upper portion 12, and a claw 122 extends and substantially perpendicularly bends from a forward end of the clamping plate 121. A pair of retaining plates 110 is respectively disposed on a top and a bottom sides of each lateral face 11, and a locking tab 111 is formed between the two retaining plates 110.

Figure 2:
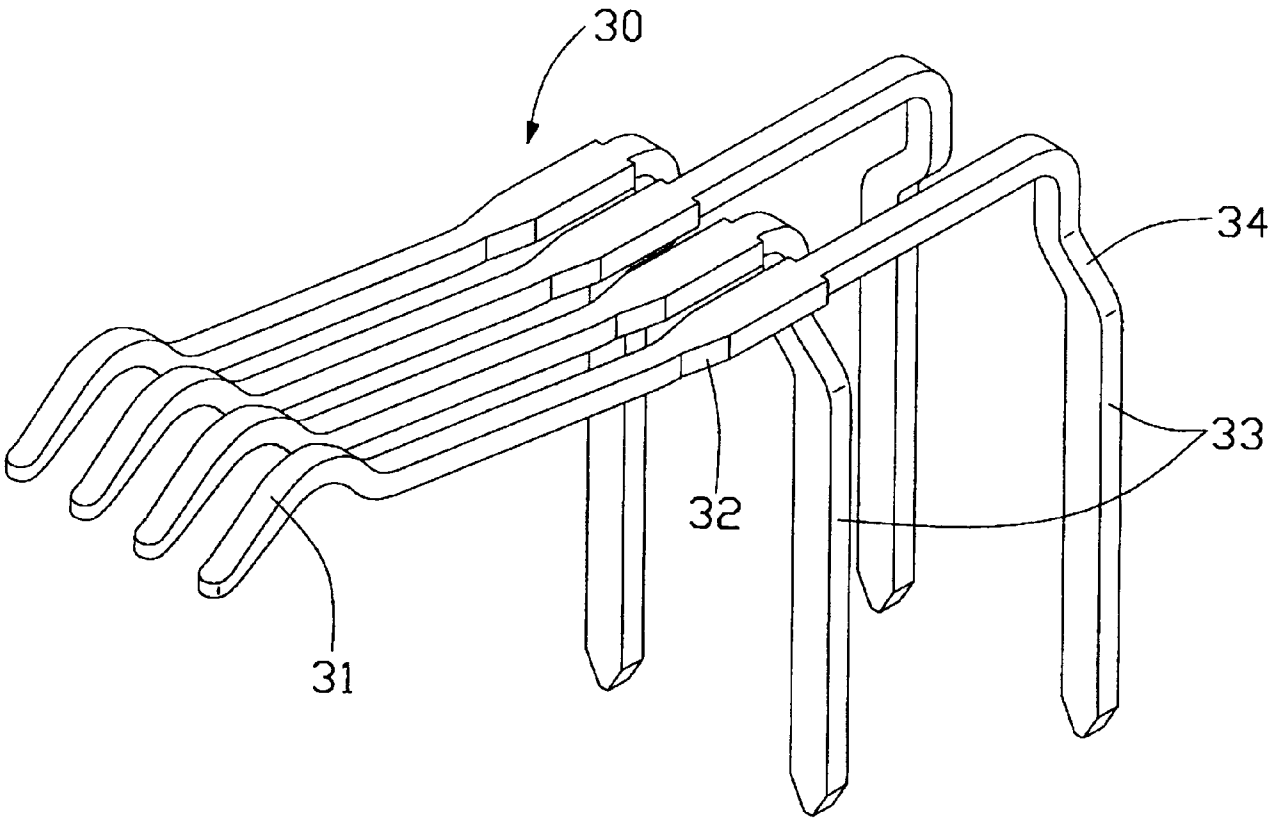
FIG. 2 is a perspective view of terminals of the electrical connector of FIG. 1.

Referring to FIG. 2, each terminal 30 includes a contacting portion 31 at one end, a soldering tail 33 at an opposite end, and a retaining portion 32 between the contacting portion 31 and the soldering tail 33. An inclined portion 34 is formed at an end of the soldering tail 33 and adjacent to the retaining portion 32, thereby increasing a distance between the soldering tails 33 while a distance between the contacting portions 31 remains constant.

Also referring to FIG. 1, the front shell 21 has a front wall 23 and a front section 241 bordering a receiving opening 24 for receiving a plug electrical connector (not shown). A plurality of guiding portions 242 extends outward from forward edges of the front section 241 for guiding the plug electrical connector into the receiving opening 24. A pair of retention arms 26 depends rearward from an upper edge of the front wall 23 and substantially bends at a right angle relative to the front wall 23. The pair of retention arms 26 are spaced apart from each other a distance and define a second notch 262 therebetween. A cutout 261 is outwardly defined in each retention arm 26 for receiving the corresponding claw 122. A lateral wall 25 extends rearward from each side edge of the front wall 23 and is substantially perpendicular to the retention arms 26. An aperture 250 is defined in each lateral wall 25 for locking with the locking tab 111 on the lateral face 11 of the dielectric housing 1. A latch 251 is formed on each lateral wall 25.

Figure 4:
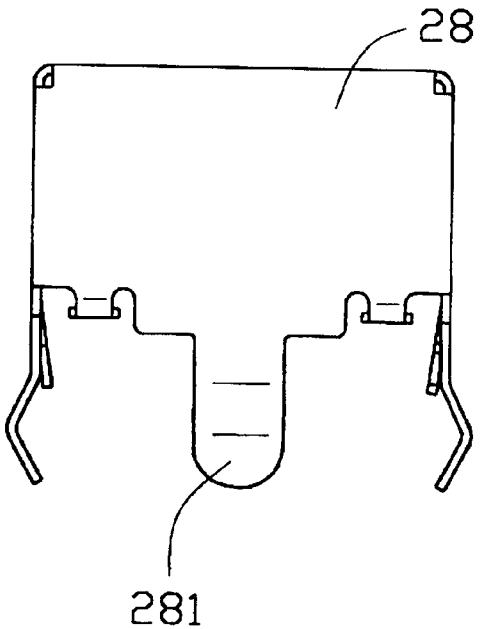
FIG. 4 is a rear view of a rear shell of the electrical connector of FIG. 1.
Figure 3:
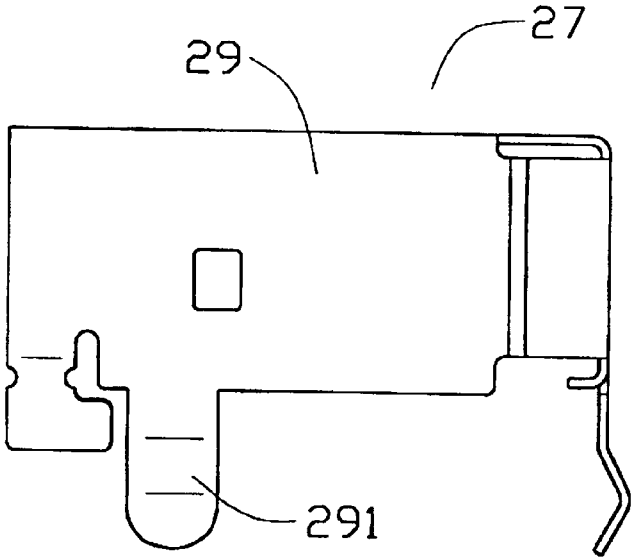
FIG. 3 is a side view of a rear shell of the electrical connector of FIG. 1.

The rear shell 22 is substantially rectangular and includes a top wall 27, a rear wall 28 and a pair of side walls 29, each side wall 29 defining a latching hole 290 for receiving the latch 251 on the lateral wall 25 of the front shell 21. A top strip 270 is formed at a middle of a front portion of the top wall 27 for contacting a shell of a mating electrical connector (not shown). Referring to FIGS. 3 and 4, a pair of latching legs 291 respectively depends from each lower edge of opposite side walls 29 and a latching leg 281 depends from a lower edge of the rear wall 28 for reliably latching the rear shell onto a printed circuit board (not shown).

Figure 5:
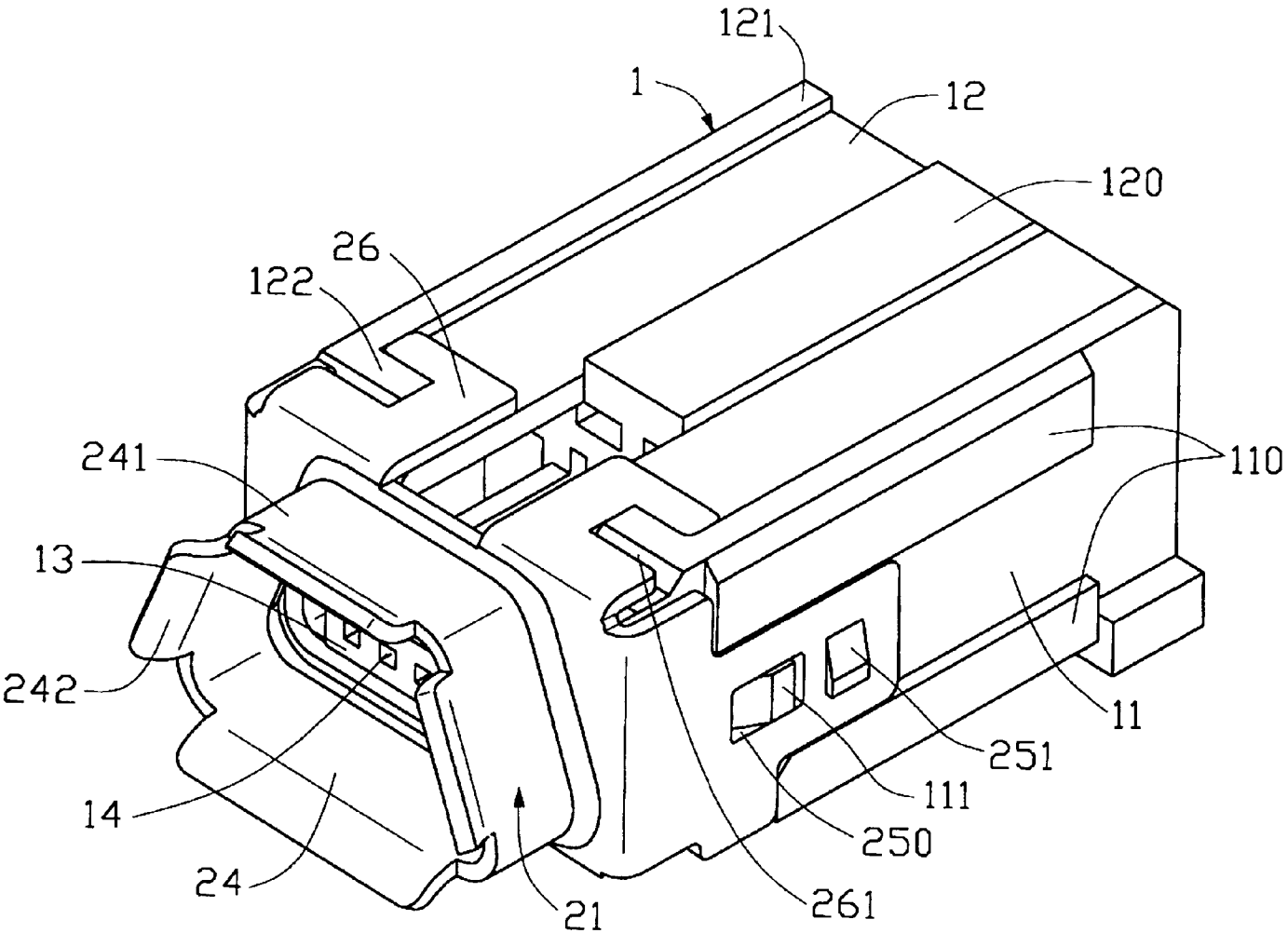
FIG. 5 is an assembled view of a front shell and a dielectric housing of the electrical connector of FIG. 1.

Referring to FIG. 5, in assembly, the terminals 30 are inserted contact portions 31 first through a rear side of the dielectric housing 1 so that the contact portions 31 are retained in the channels 14 of the projecting portion 13, the retaining portions 32 interferentially fitting in passageways in the dielectric housing 1, and the soldering tails 33 depend downwardly out of the dielectric housing 1 for soldering to a printed circuit board (not shown). The front shell 21 is assembled onto a front end 10 of the dielectric housing 1, each lateral wall 25 of the front shell 21 being inserted between the pair of retaining plates 110 of the corresponding lateral face 11 of the dielectric housing 1, attaching to the lateral face 11. The locking tab 111 on the lateral face 11 of the dielectric housing 1 locks with the aperture 250 of the lateral wall 25 of the front shell 21. A downward facing surface (not shown) of the retention arm 26 of the front shell 21 presses against the upper portion 12 of the dielectric housing 1, further helping to anchor the front shell 21 to the dielectric housing 1. The cutout 261 of each retention arm 26 receives the claw 122 on the upper portion 12 of the dielectric housing 1 thereby facilitating a reliable engagement of the front shell 21 with the dielectric housing 1.

Figure 6:
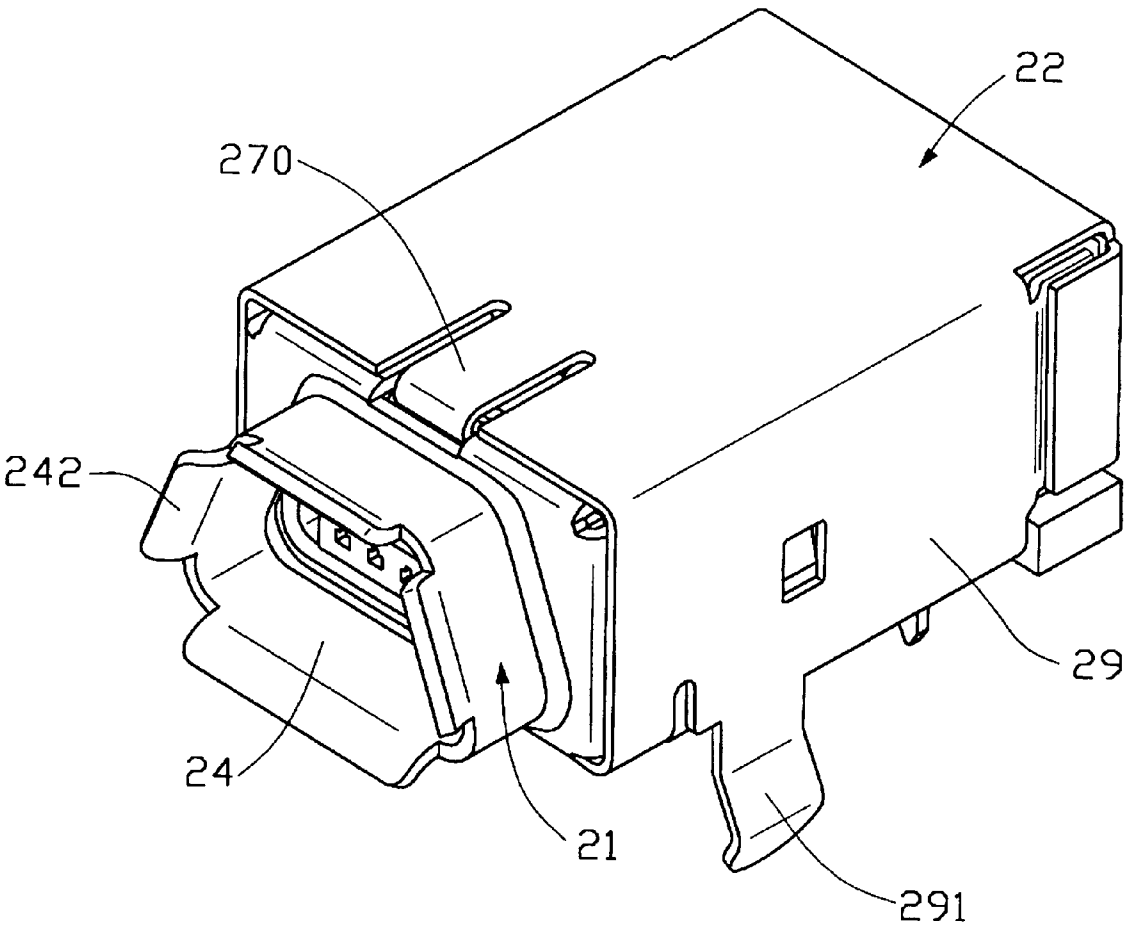
FIG. 6 is an assembled view of FIG. 1.

Further, referring to FIG. 6, the rear shell 22 is engaged with the dielectric housing 1, the side walls 29 of the rear shell 22 respectively abutting against the lateral walls 25 of the front shell 21. The latching hole 290 in each side wall 29 of the rear shell 22 receiving the corresponding latch 251 of each lateral wall 25 of the front shell 21 thereby securing the rear shell 22 to the front shell 21 and the dielectric housing 1. The top strip 270 of the top wall 27 of the rear shell 22 respectively contacts the opposite edges of the first notch 123 of the upper portion 12 of the dielectric housing 1 and the opposite edges of the second notch 262 of the front shell 21.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing including a central portion, a projecting portion extending forward from a front end of the central portion, the projecting portion defining a plurality of channels therein, an upper portion disposed with a clamping plate on each of two opposite sides thereof, and a pair of lateral faces each disposed with a pair of retaining plates;

a plurality of terminals received in the channels of the projecting portion of the dielectric housing, each terminal including a contacting portion at one end thereof, a soldering tail at an opposite end thereof, and a retaining portion between the contacting portion and the soldering tail;

a front shell having a front wall, a pair of retention arms depending from an upper edge of the front wall for latching to the clamping plates of the dielectric housing, a lateral wall depending from each of two side edges of the front wall for inserting between a corresponding pair of retaining plates of the dielectric housing; and a rear shell including a top wall, a rear wall and a pair of side walls, each side wall having a latching leg depending from a lower edge thereof and the rear shell having a latching leg depending from a lower edge thereof for latching the rear shell onto a printed circuit board;

wherein the upper portion of the dielectric housing has a first notch in front of the central portion;

wherein each clamping plate of the dielectric housing has a claw at a forward end thereof, and wherein each retention arm abuts against the upper portion of the dielectric housing and defines an outwardly facing cutout for receiving a corresponding claw of the dielectric housing;

wherein the pair of retaining plates are respectively disposed on top and bottom sides of each lateral face of the dielectric housing, and a locking tab is formed between the pair of retaining plates;

wherein an aperture is defined in each lateral wall of the front shell for receiving the locking tab on the lateral face of the dielectric housing;

wherein the soldering tail of each terminal has an inclined portion adjacent to the retaining portion for increasing a distance between the soldering tails;

wherein a front section forwardly extends from the front wall of the front shell and substantially borders a receiving opening for receiving a plug electrical connector, and the front section has a plurality of guiding portions extending outwardly from forward edges thereof for guiding the plug electrical connector into the receiving opening;

wherein a latch is disposed on each lateral wall of the front shell, and a latching hole is defined in each side wall of the rear shell for receiving the latch;

wherein a top strip is formed at a middle of a forward portion of the top wall of the rear shell for contacting a shell of a mating electrical connector, and a second notch is formed between the pair of retention arms of the front shell and aligns with the first notch of the dielectric housing for receiving the top strip.

* * * * *